US005449231A

United States Patent [19]

Lin

[11] Patent Number: 5,449,231

[45] Date of Patent: Sep. 12, 1995

[54] DRAWER SUSPENSION MECHANISM

[76] Inventor: Tsong-Chi Lin, 146,Min Chyuan Rd., Ta Fu Village,Fu Ne Hsiang, Kaohsiung Hsien, Taiwan

[21] Appl. No.: 233,760

[22] Filed: Apr. 26, 1994

[51] Int. Cl.[6] ..... A47B 88/16

[52] U.S. Cl. ..... 312/334.18; 312/330.1; 312/334.12

[58] Field of Search ..... 312/330.1, 334.12, 334.18, 312/334.19, 334.21

[56] References Cited

U.S. PATENT DOCUMENTS

| | | | |
|---|---|---|---|
| 1,109,812 | 9/1914 | Yawman | 312/334.12 |
| 1,339,842 | 5/1920 | Bergmann | 312/334.12 |
| 2,212,191 | 8/1940 | Dietz | 312/334.18 |
| 2,258,667 | 10/1941 | Wogulis | 312/334.18 |
| 2,289,281 | 7/1942 | Zalkind | 312/334.19 X |
| 2,333,843 | 11/1943 | Cox | 312/334.12 |
| 3,973,814 | 8/1976 | Entrikin | 312/334.18 X |
| 4,173,380 | 11/1979 | Düpree | 312/330.1 |
| 4,842,351 | 6/1989 | Röck et al. | 312/330.1 X |
| 4,875,747 | 10/1989 | Hollenstein | 312/330.1 |
| 5,090,786 | 2/1992 | Albiez et al. | 312/330.1 |
| 5,172,971 | 12/1992 | Albiez | 312/330.1 X |

FOREIGN PATENT DOCUMENTS

| | | | |
|---|---|---|---|
| 1519554 | 8/1978 | United Kingdom | 312/334.12 |

*Primary Examiner*—Jose V. Chen
*Assistant Examiner*—Rodney B. White
*Attorney, Agent, or Firm*—Larson and Taylor

[57] ABSTRACT

A drawer includes two side portions, two tracks fixed to the side portions, and two channels slidably engaging with the tracks. A groove and a depression are formed in the bottom of each of the side portions. A lower flange is laterally extended from each of the tracks for engaging with the bottom of the side portions. The lower flange includes two projections for engaging with the groove and the depression so as to solidly fix the tracks to the drawer.

2 Claims, 2 Drawing Sheets

DRAWER SUSPENSION MECHANISM

BACKGROUND OF THE INVENTION

1. Field of the Invention

The present invention relates to a suspension mechanism, and more particularly to a drawer suspension mechanism.

2. Description of the Prior Art

A typical drawer suspension mechanism comprises a pair of tracks fixed to the side portions of the drawer and a pair of channels fixed to the desk or the like for slidably engaging with the tracks on the drawer. The drawers are normally made of wood materials, and the tracks should be solidly secured to the drawer for supporting the drawer. The tracks should be subjected to the weight of the drawer. However, the tracks are simply fixed to the drawers by screws, such that the tracks may not be solidly fixed to the drawer and may loosen easily.

The present invention has arisen to mitigate and/or obviate the afore-described disadvantages of the conventional drawer suspension mechanisms.

SUMMARY OF THE INVENTION

The primary objective of the present invention is to provide a drawer suspension mechanism which can be solidly secured in place.

In accordance with one aspect of the invention, there is a drawer comprising two side portions, each of the side portions including a bottom portion, two tracks fixed to the side portions of the drawer respectively, and two channels slidably engaging with the tracks respectively; the improvement comprising: the bottom portions of the side portions each includes a groove and a depression formed therein, each of the tracks includes a lower flange laterally extended therefrom for engaging with the bottom portions of the side portions, the lower flange includes two projections extended therefrom for engaging with the groove and the depression of the bottom portions so as to solidly secure the tracks to the drawer.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
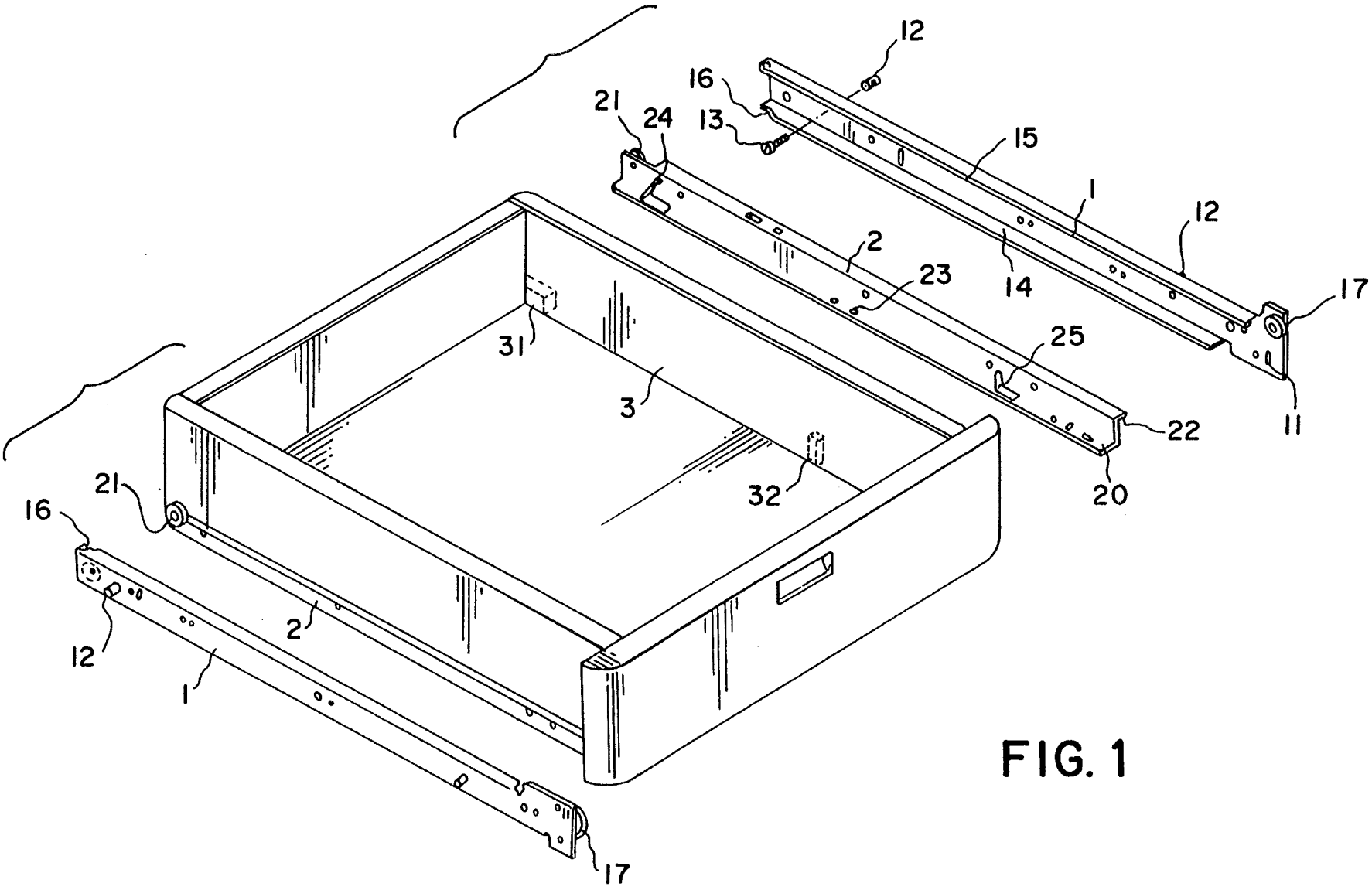
FIG. 1 is an exploded view of a drawer suspension mechanism in accordance with the present invention.
Figure 2:
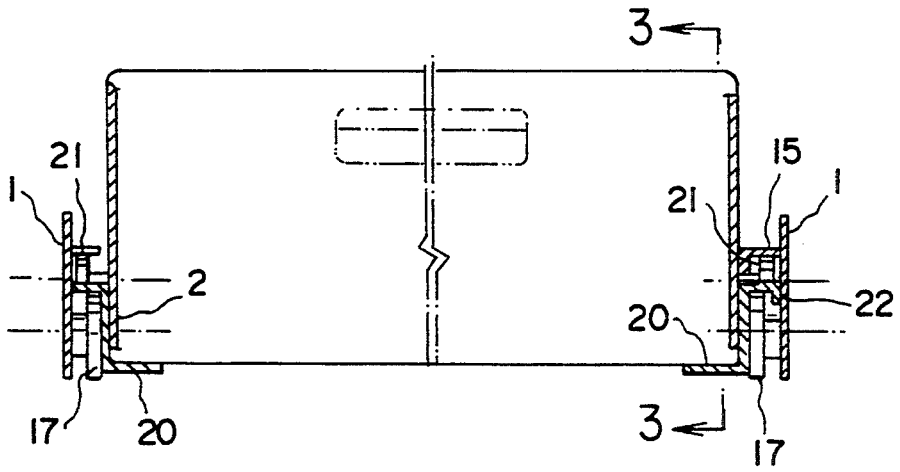
FIG. 2 is a cross sectional view of the drawer having the suspension mechanism in accordance with the present invention disposed thereon.
Figure 3:
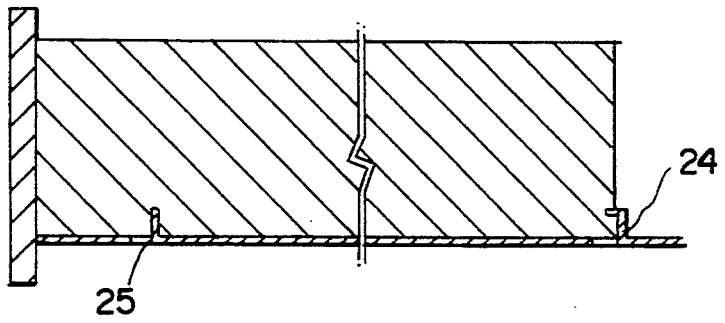
FIG. 3 is a cross sectional view taken along lines 3—3 of FIG. 2, illustrating the engagement of the projections with the groove and the depression of the side portions of the drawer.

Referring to the drawings, a drawer suspension mechanism in accordance with the present invention is provided for slidably supporting the drawer. The drawer comprises two side portions 3 each including a front portion, a rear portion and a bottom portion. A groove 31 and a depression 32 are formed in the bottom portion of each of the side portions 3 of the drawer, in which the groove 31 is located in the rear portion and the depression 32 is located in the front portion of the side portions.

Two tracks 2 are fixed to the side portions 3 of the drawer respectively. Each of the tracks 2 includes a lower flange 20 laterally extended therefrom for engaging with the bottom portion of the side portion of the drawer and an upper flange 22 laterally extended therefrom. Two holes 23 are formed in the lower flange 20 for engaging with screws so as to further solidly fix the tracks 2 to the side portions 3 of the drawer. Two projections 24, 25 are extended upward from the lower flange 20 for engaging with the groove 31 and the depression 32 of the side portions 3, such that the tracks 2 may be solidly secured to the drawer. A roller 21 is rotatably secured to each of the tracks 2.

A pair of channels 1 are slidably engaged with the tracks 2. Each of the channels 1 includes a pair of parallel ribs 14, 15 for slidably engaging with the roller 21. A number of holes 11 are formed in the channel 1 for engaging with fastening elements 12, 13 so as to fix the channels 1 to the desk or the like. The rib 14 includes a rear end having a bulge 16 formed thereon for limiting the movement of the roller 21 and for preventing the roller 21 from disengaging from the channel 1. A roller 17 is rotatably secured to the channel 1 for slidably engaging with the flange 22 of the tracks 2.

Accordingly, the drawer suspension mechanism in accordance with the present invention includes a pair of tracks 2 each having a lower flange 20 for engaging with the bottom portion of the drawer, and two projections 24, 25 are extended upward from each of the lower flanges 20 for engaging with the groove 31 and the depression 32 of the drawer, such that the tracks 2 can be solidly fixed to the drawer.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A drawer suspension mechanism comprising two side members positioned on opposite sides of a drawer for slidably supporting the drawer, each of said side members comprising:

a side portion, and a bottom portion having a groove and a depression formed therein, said side portion and said bottom portion forming a lateral and a lower limit, respectively, of the drawer;

a track fixed to said side portion, said track comprising upper and lower flanges extending laterally therefrom, said lower flange having two projections extending upwardly therefrom for engaging said groove and said depression in said bottom portion;

a roller rotatably secured to the track;

a channel fixed to a furniture side wall comprising a pair of parallel ribs for slidably engaging said roller therebetween; and a roller rotatably secured to the channel for slidably engaging the upper flange of said track, whereby inward and outward movement of the drawer is enabled.

2. The drawer suspension mechanism according to claim 1 wherein one of said parallel ribs includes a bulge formed thereon for preventing the roller secured to the track from disengaging the channel.

* * * * *